US006216362B1

(12) United States Patent
Sandor

(10) Patent No.: US 6,216,362 B1
(45) Date of Patent: Apr. 17, 2001

(54) METHOD AND APPARATUS FOR CONTROL OF THE COOLING RATE OF CAST STEEL RAILWAY WHEELS

(75) Inventor: Louis Sandor, Barrington, IL (US)

(73) Assignee: AMSTED Industries Incorporated, Chicago, IL (US)

( * ) Notice: Subject to any disclaimer, the term of this patent is extended or adjusted under 35 U.S.C. 154(b) by 0 days.

(21) Appl. No.: 09/507,319

(22) Filed: Feb. 18, 2000

(51) Int. Cl.[7] ..... F26B 7/00

(52) U.S. Cl. ..... 34/381; 34/486; 34/497; 34/527; 34/543; 34/555; 34/560; 34/562

(58) Field of Search ..... 34/381, 486, 491, 34/497, 527, 543, 555, 560, 562, 201; 148/540, 853, 585; 250/559.22, 559.24; 73/598, 620, 622

(56) References Cited

U.S. PATENT DOCUMENTS 3,753,789 8/1973 Kucera et al. ..... 148/3
3,812,708 * 5/1974 Cowan et al. ..... 73/628 X
4,554,624 * 11/1985 Wickman et al. ..... 364/148
4,798,963 * 1/1989 Wittkopp et al. ..... 250/560
5,150,656 * 9/1992 Lobb et al. ..... 104/162
5,864,065 * 1/1999 Prorok et al. ..... 73/622

* cited by examiner

*Primary Examiner*—Stephen Gravini
(74) *Attorney, Agent, or Firm*—Edward J. Brosius; Stephen J. Manich

(57) ABSTRACT

The disclosure provides an apparatus for controlling the rate of heat transfer from as-cast railroad wheels after their removal from the mold utilizing a plurality of vertically adjustable caps with a cap positioned over each wheel to control the rate of heat transfer therefrom as it is transported to a successive operation, each cap having a generally symmetrical shape to inhibit or reduce deflection of radiant energy from the wheel, and the disclosure also provides a method for controlling the rate of heat transfer including a control system to provide the requisite displacement of each cap from the associated wheel to control cooling of the wheel prior to its subsequent operation.

16 Claims, 4 Drawing Sheets

METHOD AND APPARATUS FOR CONTROL OF THE COOLING RATE OF CAST STEEL RAILWAY WHEELS

BACKGROUND OF THE INVENTION

The present invention relates to heat treatment and processing of cast steel railroad wheels. More specifically, a method and associated apparatus are disclosed for increasing or reducing the rate of heat loss from as-cast railroad wheels.

Historically, railroad wheels have generally been produced by forging or casting of cast iron or cast steel. The cast steel wheels are primarily produced by a bottom-pouring casting technique. However, any of the production processes require control of the cooling cycles or rates to maintain the crystalline microstructure of the cast or forged wheels. In the above-noted bottom-pouring technique, the as-cast wheels are removed from the casting mold for transfer to subsequent operations to remove the hub core, sprues and risers, for inspection and for heat treating and normalizing at various production stages.

Although the railroad wheels are normalized, their microstructure is influenced by the as-cast temperature and the subsequent cooling rate. This is especially influenced by mass differences from the relatively thick cross-section at the outer tread portion, through the thinner connecting web, to the most massive section of the wheel at the axle hub. The cooling rate influences the microstructure, the rate of formation of inclusions in the grain boundaries, their distribution in the microstructure, dislocation formation, dislocation movement across the grain boundaries, residual stresses and their locations, as well as other metallurgical and mechanical properties. In addition, the cooling cycle must provide the wheel at the subsequent production operation from the shake-out at the correct temperature for the next operation, which is not necessarily room temperature.

Production practices have required transport of railway wheels on a continuous conveyor path through an in-line kiln. In general, the structure of the kiln provided refractory lined walls and roof in an elongated chamber similar to a muffle furnace. In at least one known operation, the capacity or rate of heat transfer could be accelerated by raising the upper or roof panels to provide a greater volume of air flow past the wheels. The cooling practice did not desire or require a water or hot oil quench, and the slower cooling rate from air cooling or air quench practice to achieve the desired properties was preferred.

Another cooling practice utilized insulating disks poised above the axle hub to reduce the dissipation of radiant heat from the hub area of the wheel. The wheels moved in intermittent or discrete steps to perform the cooling cycle. This practice and the associated insulating disks, which are applied after the drawing furnace, are taught in U.S. Pat. No. 3,753,789 to Kucera et al.

No known assembly or method has provided controlled cooling of the as-cast railroad wheels with discrete or individual parametric control to provide the requisite wheel temperature for subsequent manufacturing practices.

SUMMARY OF THE INVENTION

A method and apparatus has a generally hemispherical cap for individually controlling the rate of heat transfer from an as-cast steel railroad wheel. The cap is suspended above the individual wheels to isolate the wheel to maintain its heat losses. More particularly, apparatus is connected to the insulated caps to raise or lower the cap. Increasing the height of the insulated hemispherical cap above the wheel allows more radiant energy to freely escape from the wheel, which allows the wheel to more rapidly cool.. Alternatively, maintaining the cap in proximity to the wheel maintains or retains the heat in the wheel. Control of the position of the cap close to or further from the wheel as it progresses on its path is accommodated by a controller coupled to either, or both, a motion sensor or temperature sensor to position the disks based on empirical data for a specific operation, temperature, rate of travel, wheel size or other known parameter.

BRIEF DESCRIPTION OF THE DRAWING

In the several figures of the Drawing, like reference numerals identify like components, and in the drawing.

DETAILED DESCRIPTION OF THE DISCLOSURE

Figure 1:
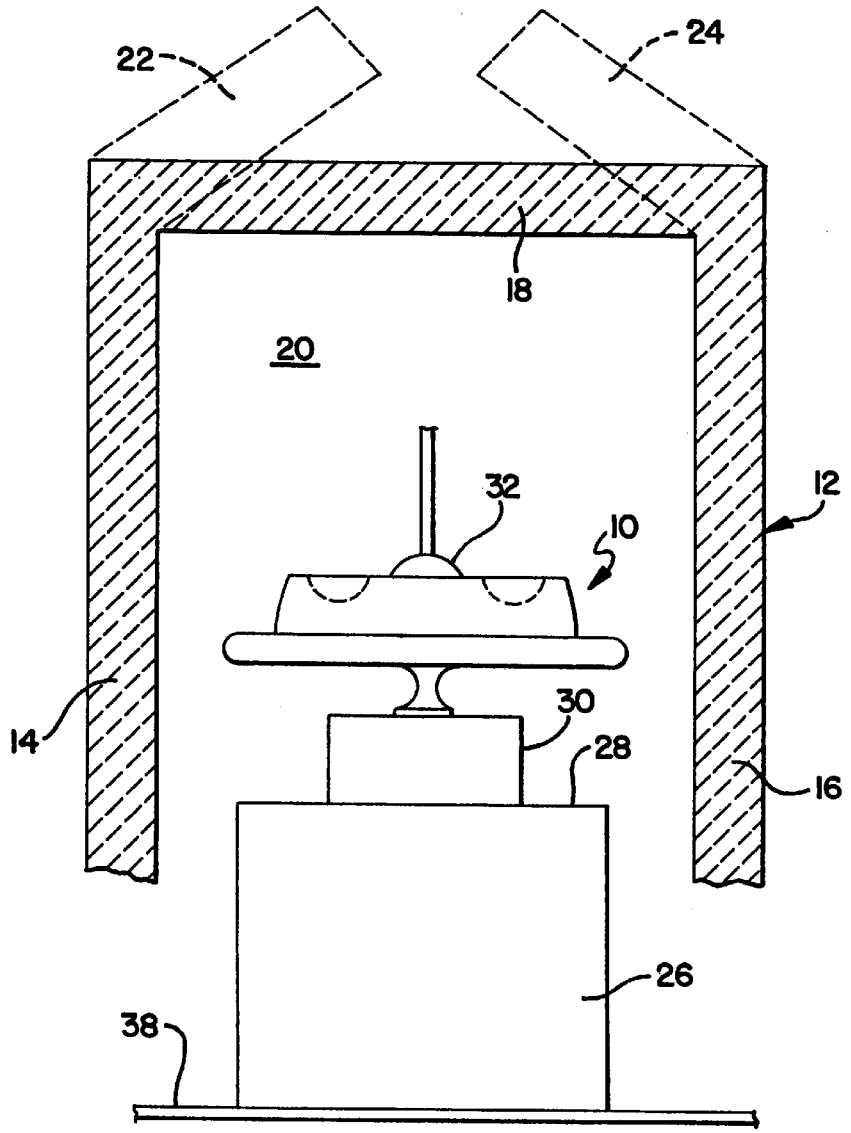
FIG. 1 is a schematic end view of a prior art heat-transfer kiln in a normal operating mode, showing a phantom outline of an open-roof operation.
Figure 6:
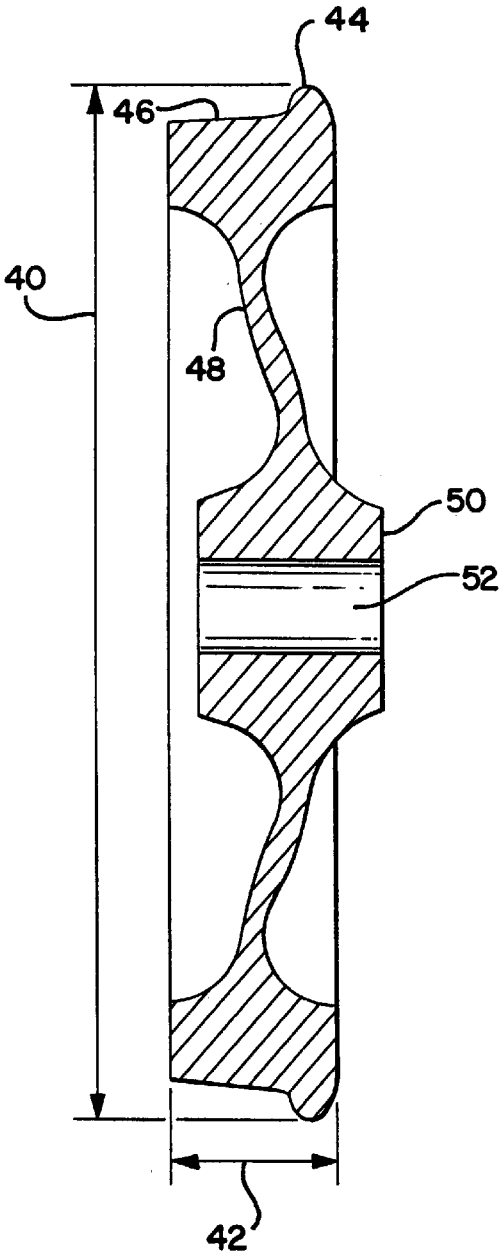
FIG. 6 is a cross-sectional view of a typical railroad wheel.
Figure 7:
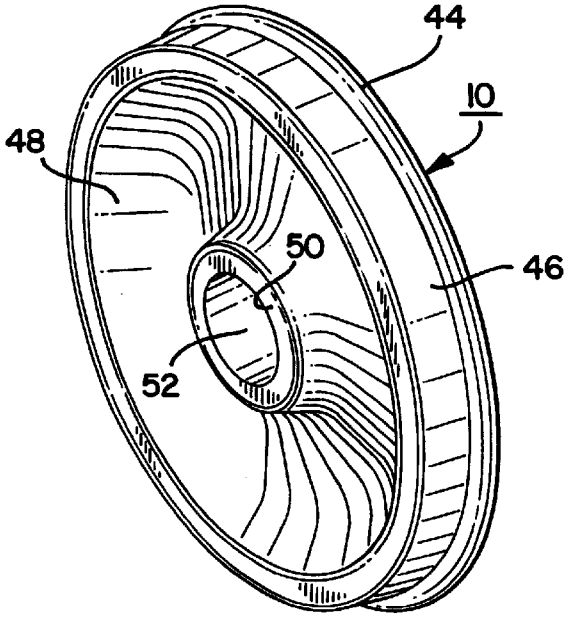
FIG. 7 is an oblique side view of an exemplary railroad wheel on end.

FIG. 1 illustrates an as-cast railroad wheel 10 at an elevated temperature in prior-art heat-transfer assembly or kiln 12. Finished railroad wheels 10 in FIGS. 6 and 7 are respectively noted in cross-section and on end, as an illustration. In FIGS. 6 and 7, wheel 10 has outer diameter 40 with a shallow wall thickness 42. Wheel 10 includes flange 44, tread 46, web 48, hub 50 and axle bore 52.

Figure 2:
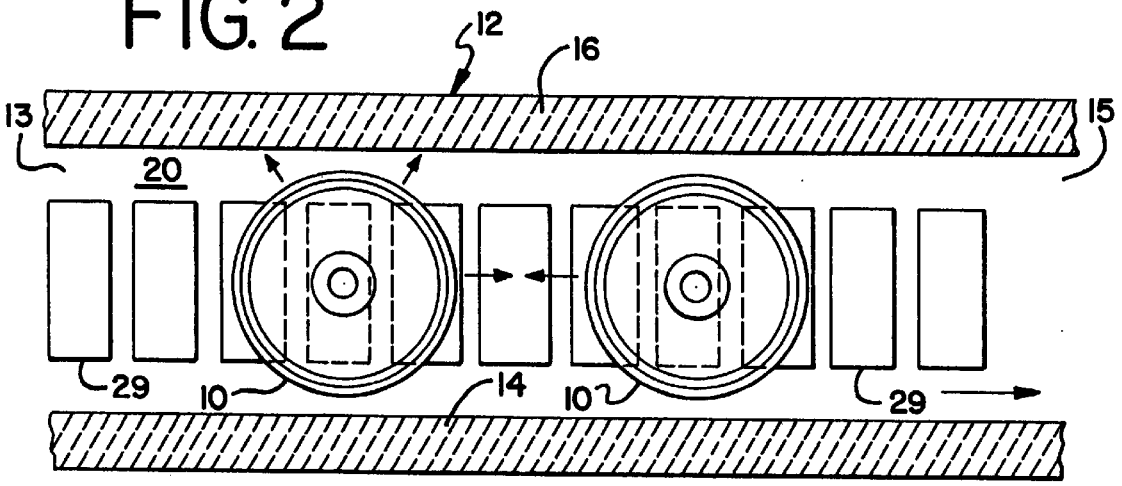
FIG. 2 is a plan view of a conveyor apparatus and wheels thereon progressing through the kiln of FIG. 1.

Kiln 12 in FIGS. 1 and 2 has first sidewall 14, second sidewall 16 and roof 18 to enclose chamber 20. In an alternative embodiment of kiln 12, roof 18 may be provided with movable segments 22 and 24, which open to increase air flow and the dissipation of radiant energy through chamber 20 and thus to increase heat transfer from wheels 10, which segments 22 and 24 are noted in dashed outline.

Conveyor assembly 26 with upper surface 28 extends through chamber 20. Wheels 10 in chamber 20 are positioned atop pedestals 30, which are set on surface 28. It is known in the art that surface 28 may have a plurality of discrete plates or cleats 29 shown in FIG. 2 or be a continuum, and this is not a limitation. In the as-cast state, wheels 10 may be at a temperature in excess of 2200° F. and include sprues and risers from the casting process, which sprues and risers must be removed from finished wheel 10, as shown in FIG. 7. Specifically, hub riser 32 is noted in FIG. 1, but it is known that there may be a plurality of sprues and risers emanating from the surface of a wheel. However, downstream processing of wheels 10 are performed at temperatures significantly below the temperature of as-cast wheel 10 when it is removed from its mold, not shown. Further, wheels 10 are allowed to cool or air quench at a controlled rate to permit the crystalline structure to form at a desired rate and to allow the grain growth to proceed in a desired manner. The resultant grain structure, as well as the related chemical, intercrystalline constituents and mechanical properties of wheel 10 are in large part a consequence of this initial controlled-cooling process. The above-noted cooling practice of kiln 12 is operable in gross and provides only nominal control of a batch, that is more than one, of wheels 10 within kiln 12. The precise length and wheel capacity of chamber 20 may vary with the available production space, which length and heat transfer rate within chamber 20 will effect the rate of movement of conveyor 26.

In FIG. 1, it can be appreciated that the broad portion of wheel 10 with web 48 across outer diameter 40 will provide a large emitting surface for emission of radiant energy. However, radiant energy is also emitted from wheel lower surface 56 toward floor 38, as well as from tread 46 and flange 44 toward walls 14 and 16. In elongate chamber 20, heat is conducted from kiln 12 at kiln ends 13 and 15, or alternatively in a kiln 12 with movable roof segments 22 and 24 heat may be dissipated through an open roof 18. This dissipation of heat is relatively uncontrolled for each piece, wheel 10, in the batch. It is known that delays or stoppage of conveyor 26 for any unusual length of time will result in changes in the physical and structural characteristics of wheels 10, and may impact the downstream processing and inspection requirements of wheels 10 caught in such a delay. This negative impact is an undesirable characteristic of the kiln-style cooling practice.

Figure 8:
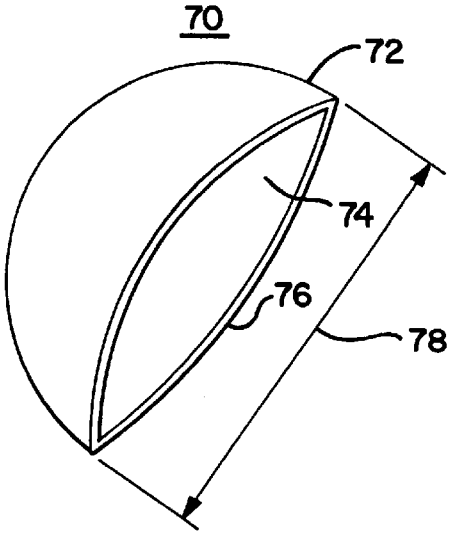
FIG. 8 is an illustrative diagrammatic oblique view of an insulating cap.

The present invention provides apparatus for individually controlling the rate of heat transfer from wheels 10 either within a chamber 20 of a kiln-style structure or outside of such chamber 20. The apparatus in FIG. 8 appears as a hemispherical cap 70 with outer shell 72, inner volume 74, lower lip 76 and outer diameter 78 at lower lip 76. Diameter 78 is considered to be at least as large as outer diameter 40 of wheel 10, and it is understood that diameter 40 may vary between wheel styles. In consideration of this fact, cap diameter 78 may be provided in a single diameter large enough to accommodate all wheel diameters 40 or caps 70 of varying sizes may be provided to mate with appropriately sized wheels 10. This alternative is available to the user, but does not negate operation of the control or use of cap 70, although it may require adjustment of the control parameters. Inner surface 73 of volume 74 may be lined with a refractory material to provide greater heat reflection, inhibit warpage of cap 70 and provide better heat-transfer control by cap 70. Although cap 70 is illustrated as a hemisphere, it is considered that a generally symmetrical shape would be operable to provide the requisite reflective capabilities for the operating system.

Figure 3:
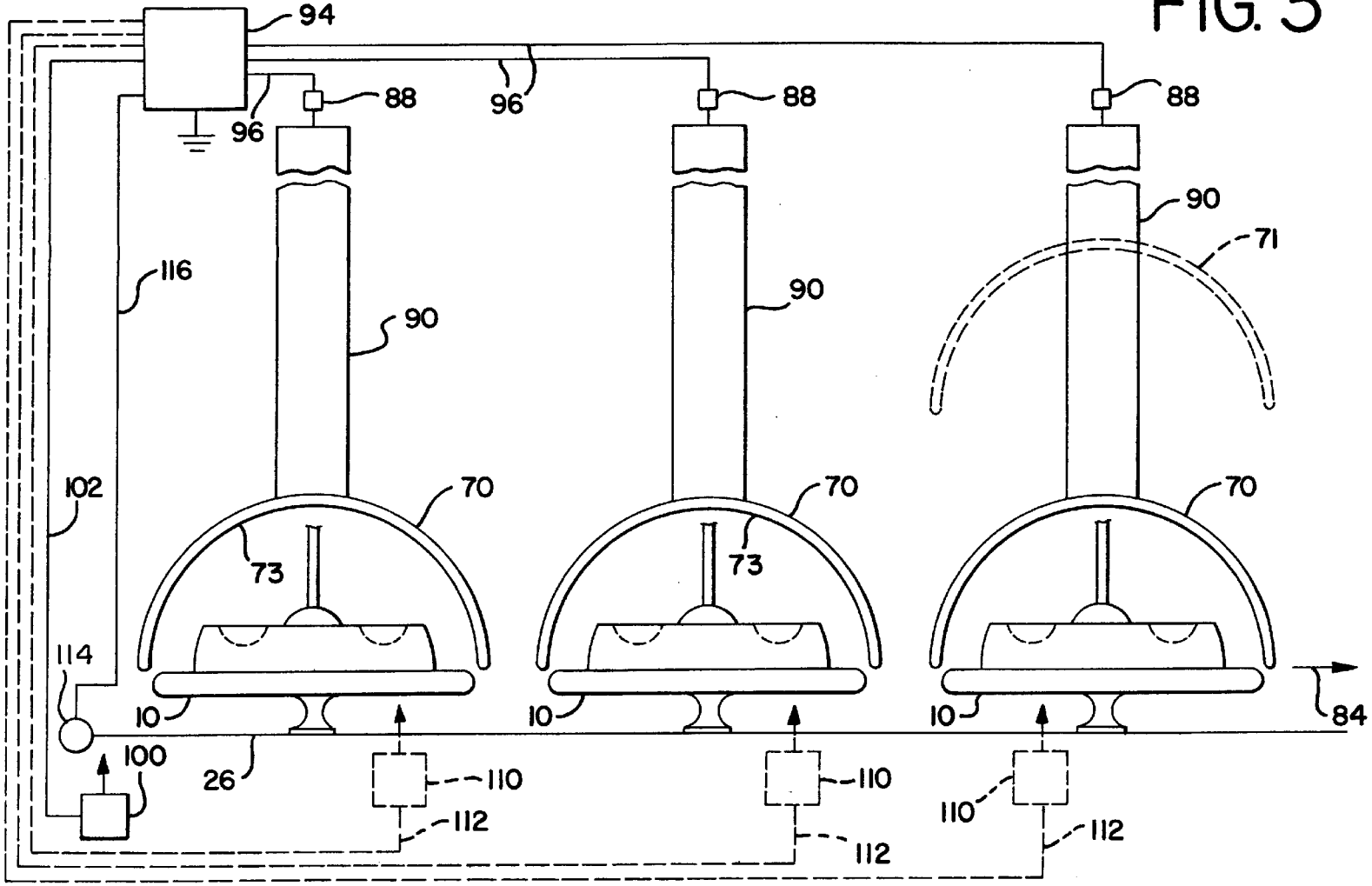
FIG. 3 is an elevational side view of multiple wheels on a conveying apparatus with illustrative insulating caps and an illustrative control arrangement.
Figure 5:
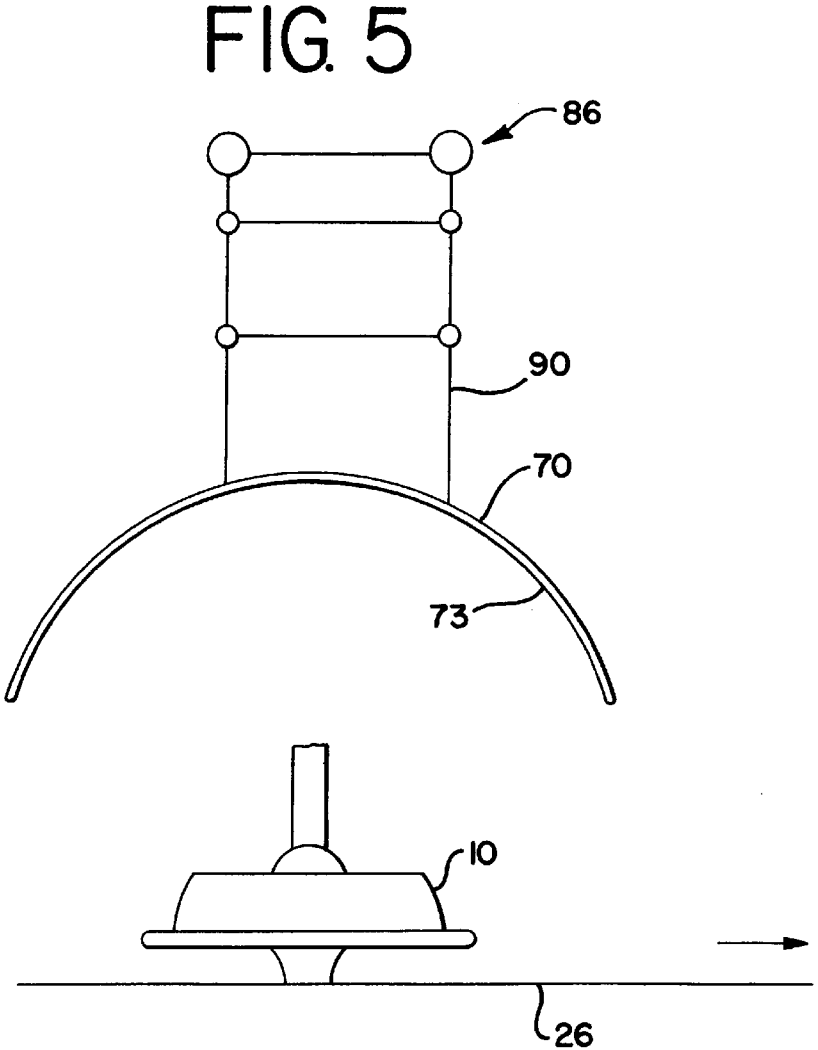
FIG. 5 is a side elevational view of a wheel on a conveying apparatus with an insulating cap operable on a trolley arrangement in a cooling operation wherein the wheels are each separated by a discrete and equal distance.

In an exemplary structure 80 in FIG. 3, wheels 10 are noted on conveyor assembly 26. Caps 70 are positioned over each individual wheel 10. The caps 70 are operable to move with wheels 10 as they progress on conveyor 26 in the illustrative direction marked by arrow 84. Various arrangements for overhead movement are available such as a monorail or the rail and wheel structure 86 in FIG. 5. Each cap 70 is coupled to an operator 88, which may as examples be a decade motor, stepper motor, a worm gear on a motor or other moving device, by connector 90. Operators 88 move caps 70 closer to wheels 10 to contain or retain heat in wheels 10, which may be viewed as a decrease in heat transfer rate. Alternatively, caps 70 may be elevated over a range of clearances, as noted by dashed outline 71 in FIG. 3.

Operators 88 are coupled to controller 94 by lines 96 in FIG. 3, which is also connected to sensor 100 by line 102, which sensor is operable to monitor the movement of conveyor line 26, and provides a sensed signal to controller 94 of the movement of conveyor 26 and its rate of movement. Further, sensors 110 are temperature sensors providing signals over lines 112 to controller 94. In response to these signals either individually or in concert, controller 94 is operable to compare the signals to empirical data and provide a control signal to operators 88 to raise or lower caps 70 to decrease or increase the rate of heat transfer, and a second signal may be provided to drive apparatus 114 by line 116 to control the rate of movement for conveyor 26 for similar control of the rate of heat transfer. These control signals may be correlated by controller 94 to control the rate of heat transfer for attainment of the desired wheel temperature prior to the next processing operation. In this manner, controller 94 controls the rate of heat transfer from each individual wheel 10 as it progresses along the path determined by conveyor 26.

Figure 4:
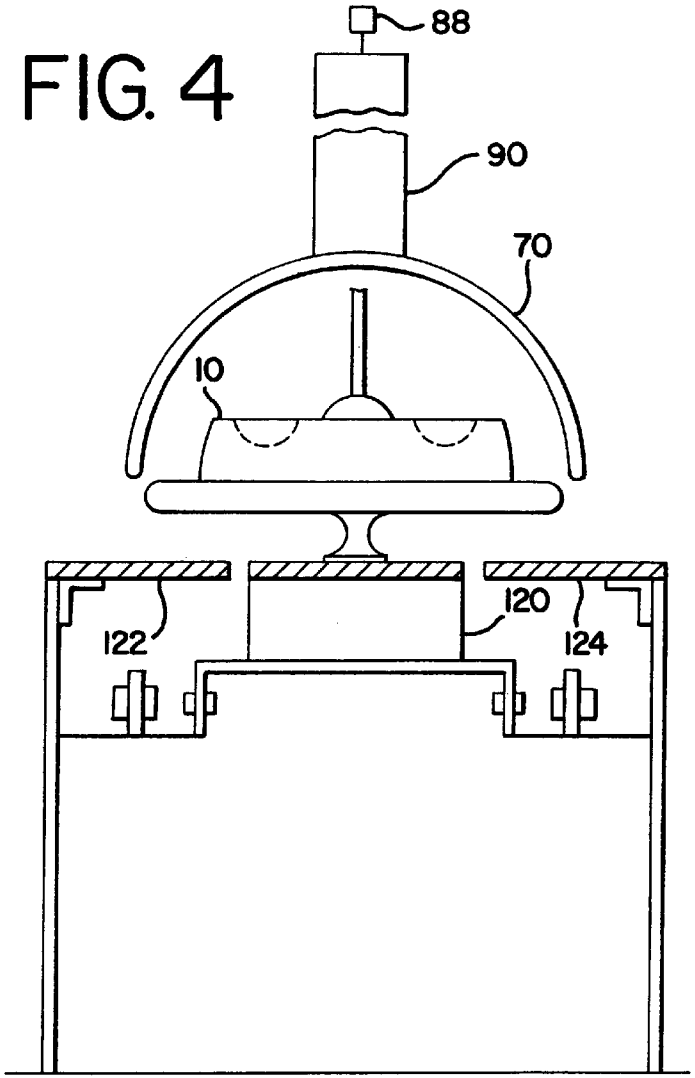
FIG. 4 is a schematic elevational end view of a hemispherical insulating cap over a wheel on an insulating pedestal atop a conveying apparatus.

A further embodiment of the invention is shown in FIG. 4, which embodiment has pedestal 30 on conveyor 26 as a refractory mass 120 for mounting wheel 10. In addition, refractory plates 122 and 124 are positioned on either side of mass 120 to insulate conveyor 26 and to symmetrically surround the wheel for uniform reflection of heat.

As noted above, rail and wheel structure 86 is available to transport caps 70. However, in this specific structure, the cap 70 and connector 90 may be fixed in position if the wheels 10 are being transferred in repetitively discrete positions. Further, such a rail system is operable in a kiln 20 with an open roof section.

While this invention has been described in connection with certain specific embodiments thereof, it is to be understood that this is by way of illustration and not by way of limitation; and the scope of the appended claims should be construed as broadly as the prior art will permit.

I claim:

1. A method for controlled cooling of cast metal railroad wheels, said wheels positioned on a conveying apparatus for transfer along a predetermined path through a cooling, processing and heat treating facility, said apparatus having means for sensing movement of said apparatus and means for controlling said apparatus, said method comprising:

providing a plurality of generally hemispherical reflective caps above said wheels, said caps suspended by means for positioning;

positioning one of said reflective caps above each said wheel to control its rate of radiant heat transfer, said reflective caps adjustable by means for positioning coupled to said controlling means;

monitoring movement of said conveying apparatus with said sensing means;

communicating said sensed movement of said apparatus from said sensing means to said controlling means for comparison of said sensed rate of movement to empirical data to provide a control signal from said control means to said positioning means;

moving said reflective caps by said positioning means to one of closer to said wheel for reducing said rate of heat transfer and further from said wheel for accelerating said rate of heat transfer from said wheels;

raising and lowering said caps in response to said sensed rate of movement for one of acceleration and reduction of the rate of heat transfer from said wheels along said path.

2. A method as claimed in claim 1 for controlled cooling of cast metal railroad wheels, said wheels positioned on a conveying apparatus for transfer along a predetermined path through a cooling, processing and heat treating facility, said apparatus having means for sensing movement of said apparatus and means for controlling said apparatus, said method further comprising providing means for sensing temperature of each said wheel, said temperature sensing means coupled to said control means;

positioning said reflective caps over said wheels in response to at least one of said sensed movement of said apparatus and sensed temperature of said wheels.

3. A method as claimed in claim 1 for controlled cooling of cast metal railroad wheels, said wheels positioned on a conveying apparatus for transfer along a predetermined path through a cooling, processing and heat treating facility, said apparatus having means for sensing movement of said apparatus and means for controlling said apparatus, said method further comprising providing a conveying apparatus for transfer of said wheels in incremental steps; monitoring said incremental steps with said means for sensing movement of said conveying apparatus to provided said control means with a signal for positioning of said reflective caps.

4. A method as claimed in claim 1 for controlled cooling of cast metal railroad wheels, said wheels positioned on a conveying apparatus for transfer along a predetermined path through a cooling, processing and heat treating facility, said apparatus having means for sensing movement of said apparatus and means for controlling said apparatus, said method further comprising providing a plurality of refractory pedestals on conveying apparatus, each said wheel positioned on a pedestal to insulate said conveying apparatus from said heat and to provide more uniform heat transfer from said wheels.

5. An assembly for control of heat transfer of as-cast railroad wheels after removal from their casting molds for attainment of a desired temperature in said wheels prior to subsequent processing operations, said assembly comprising:

at least one as-cast steel railroad wheel;

means for conveying, said at least one railroad wheel through a heat transfer operation to reduce the temperature of said wheel from the mold temperature to a desired temperature at or below a fixed temperature, said heat transfer provided at a predetermined rate;

means for adjusting rate of heat transfer from said railroad wheel;

means for monitoring rate of movement of said conveying means;

means for controlling said rate of movement of said conveying means and said means for adjusting said rate of heat transfer;

means for sensing said rate of movement;

means for coupling said sensing means to said means for controlling to communicate said rate of movement to said control means;

said means for controlling operable to move said means for adjusting said rate of heat transfer as a function of said sensed rate of movement to provide said wheel at said desired temperature.

6. An assembly for control of heat transfer of as-cast railroad wheels after removal from their casting molds for attainment of a desired temperature in said wheels prior to subsequent processing operations as claimed in claim 5 wherein said means for conveying is a conveyor with a plurality of positions for said wheels, said means for adjusting is an insulating cap with an operator to raise or lower said cap, said operator coupled to said controller by said coupling means and operable to raise said cap from proximity to said wheel to accelerate said heat transfer from said wheel and to lower said cap into proximity with said wheel on said conveying means to reduce said rate of heat transfer from said wheel in response to said rate of movement of said conveying means.

7. An assembly for control of heat transfer of as-cast railroad wheels as claimed in claim 6 wherein said insulating cap has a generally symmetrical shape.

8. An assembly for control of heat transfer of as-cast railroad wheels as claimed in claim 6 wherein said insulating cap has a generally hemispherical shape.

9. An assembly for control of heat transfer of as-cast railroad wheels from their casting molds for attainment of a desired temperature in said wheels prior to subsequent processing operations as claimed in claim 5 and further comprising means for sensing a temperature of said wheel on said conveying means;

said temperature sensing means connected to said control means by said means for coupling to communicate a sensed wheel-temperature signal to said control means;

said means for conveying is a conveyor with a plurality of positions for said wheels, said means for adjusting said rate of heat transfer is a hemispherical insulating cap with an operator to raise or lower said cap, said operator coupled to said controller by said coupling means and operable to raise said cap from proximity to said wheel to accelerate said heat transfer from said wheel and to lower said cap into proximity with said wheel on said conveying means to reduce said rate of heat transfer from said wheel in response to said sensed temperature and said rate of movement of said conveying means.

10. A cap for positioning over a railroad wheel at an elevated temperature to control the rate of heat transfer from said wheel, said cap comprising:

a shell having a generally hemispherical shape, said cap hemisphere having an opening with a first diameter;

said wheel having a generally circular shape with a second diameter;

said first diameter being greater than said second diameter to cover said wheel and to maintain said heat in said wheel at a minimum rate of heat transfer when said cap envelops said wheel, said cap operable for reflecting heat from said wheel to reduce the net dissipation of radiant energy from said wheel.

11. A cap for positioning over a railroad wheel at an elevated temperature to control the rate of heat transfer from said wheel, as claimed in claim 10 wherein said cap has a generally hemispherical shape with an inner surface;

a heat-reflecting material lining, said lining secured to said inner surface to insulate said shell.

12. A cap for positioning over a railroad wheel at an elevated temperature to control the rate of heat transfer from said wheel, as claimed in claim 10, said cap further comprising means for operating said cap;

means for connecting said cap to said means for operating;

said operating means operable to move said cap between elevated positions relatively remote from said wheel and lowered positions in proximity to said wheel to respectively provide one of greater heat transfer from said wheel and lesser heat transfer from said wheel.

13. A control circuit for a heat transfer control assembly for as-cast railroad wheels at an elevated temperature on means for conveying said wheels, said circuit comprising:

means for sensing rate of movement of said conveying means;

means for controlling said rate of movement of said conveying means, said controlling means having empirical data correlating temperature and rate of movement of said conveying means;

means for adjusting said rate of heat transfer from said wheels on said conveying means;

means for coupling said sensing means and said heat-transfer adjusting means to said control means;

said control means operable to receive said sensed signal from said sensing means and to provide a control signal to said conveying means and said heat transfer adjusting means in response to said sensed signal to control said rate of heat transfer from said wheels to provide said wheels below a first predetermined temperature downstream of said heat transfer assembly.

14. A control circuit for a heat transfer control assembly for as-cast railroad wheels at an elevated temperature on means for conveying said wheels as claimed in claim 13, said circuit further comprising means for sensing temperature of said wheels, said temperature sensing means connected to said controller by said coupling means and operable to communicate a sensed signal to said controller, said control means operable to receive said sensed signal from said temperature sensing means and to provide a control signal to said conveying means and said heat transfer adjusting means in response to said sensed temperature signal to control said rate of heat transfer from said wheels to provide said wheels below a first predetermined temperature downstream of said heat transfer assembly.

15. A control circuit for a heat transfer control assembly for as-cast railroad wheels at an elevated temperature on means for conveying said wheels as claimed in claim 13, said circuit further comprising means for sensing temperature of said wheels, said temperature sensing means connected to said controller by said coupling means and operable to communicate a sensed signal to said controller, said control means operable to receive said sensed signal from said temperature sensing means and to provide a control signal to said conveying means and said heat transfer adjusting means in response to said sensed temperature signal to control said rate of heat transfer from said wheels to provide said wheels above a second predetermined temperature downstream of said heat transfer assembly, said second predetermined temperature being lower than said first predetermined temperature.

16. A control circuit for a heat transfer control assembly for as-cast railroad wheels at an elevated temperature on means for conveying said wheels as claimed in claim 13, said circuit further comprising means for sensing temperature of said wheels, said temperature sensing means connected to said controller by said coupling means and operable to communicate a sensed signal to said controller, said control means operable to receive said sensed signal from said temperature sensing means and to provide a control signal to said conveying means and said heat transfer adjusting means in response to said sensed temperature signal to control said rate of heat transfer from said wheels to provide said wheels below a first predetermined temperature and above a second predetermined temperature downstream of said heat transfer assembly, said first predetermined temperature being greater than said second predetermined temperature.

* * * * *